US007527529B2

(12) United States Patent
Ho et al.

(10) Patent No.: US 7,527,529 B2
(45) Date of Patent: May 5, 2009

(54) MICROPHONE CONNECTOR

(75) Inventors: Hsin-Tsung Ho, Taipei Hsien (TW); Chung-Hsin Huang, Taipei Hsien (TW); Mei-Chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 52 days.

(21) Appl. No.: 11/550,592

(22) Filed: Oct. 18, 2006

(65) Prior Publication Data

US 2008/0096434 A1 Apr. 24, 2008

(51) Int. Cl.
*H01R 24/00* (2006.01)
*H01R 33/00* (2006.01)

(52) U.S. Cl. ..... 439/660; 439/83; 439/857

(58) Field of Classification Search ..... 439/660, 439/668, 669, 856, 857, 78, 81, 83, 876
See application file for complete search history.

(56) References Cited

U.S. PATENT DOCUMENTS 6,146,156 A * 11/2000 Yang ..... 439/83
6,273,760 B1 * 8/2001 Wu ..... 439/668
6,676,451 B2 * 1/2004 Suzuki et al. ..... 439/668

OTHER PUBLICATIONS

English translation of the Abstract of the Foreign Patent Document No. 00395603 published on Jun. 21, 2000 and listed in the Information Disclosure Statement submitted on Oct. 19, 2006.

* cited by examiner

*Primary Examiner*—Felix O Figueroa
(74) *Attorney, Agent, or Firm*—WPAT, P.C.; Anthony King

(57) ABSTRACT

A microphone connector includes an insulation housing and an electrical contact. The insulation housing has an insertion passage arranged at a top surface thereon, a receiving space arranged at a bottom surface thereon and communicated with the insertion passage and grooves passing through opposite sidewalls of the insulation housing. The electrical contact includes a body portion arranged up on the sidewalls, a soldering portion arranged at one end of the body portion, at least two opposite arms arranged at the other end of the body portion and received in the corresponding grooves respectively and elastic connection portions respectively arranged at the side arms and received in the receiving space. While a terminal of a microphone inserts into the insertion passage and electronically couples to the elastic connection portions to form multi-conductive areas, signal is transmitted between the microphone and the microphone connector stably through the multi-conductive areas.

10 Claims, 6 Drawing Sheets

MICROPHONE CONNECTOR

BACKGROUND OF THE INVENTION

1. Field of the Invention

The invention relates to a microphone connector, and particularly to a microphone connector capable of transmitting signal stably.

2. The Related Art

According to the current development of electrical technology, portable electrical devices such as mobile phones, personal digital assistants, and others, are capable of communicating with other electrical devices through electrical connectors configured therein. Because of downsizing issue and reducing weight, size of the portable electrical devices is getting smaller. Consequently, downsizing size issue is also a designing purpose of the electrical connectors.

A microphone connector is disclosed in Taiwan Patent Application No. 087218667. The microphone connector is arranged at a surface of a printed circuit board. The microphone connector includes a housing, a receiving room leaded to a top surface and a bottom surface of the housing, a cyclic projection arranged at the bottom surface of the housing and surrounded the receiving room. An E-shape electrical contact has two fixed portions and a connection portion between the fixed portions. A soldering portion is arranged at a free end of the fixed portion and perpendicular to the fixed portion for soldering to the printed circuit board. While the housing and the E-shape electrical contact are assembled, the fixed portions of the E-shape electrical contact respectively contact both sides of the housing and the connection portion of the E-shape electrical contact is received in the receiving room of the housing.

While the microphone connector engages with a microphone, connection portion of the E-shape electrical contact electrical couples to a terminal of the microphone to form single conductive point for transmitting signal therebetween. Therefore, the signal is transmitted between the microphone and the microphone connector only through the single conductive point between the terminal of the microphone and the connection portion of the microphone connector. However, if the single conductive point between the microphone and the microphone connector would not be set up, for example the connection portion departing from the microphone connector, the connection portion broken up and so on, the signal transmitting between the microphone and the microphone connector is incorrectly

SUMMARY OF THE INVENTION

An object of the present invention is to provide a microphone connector having multi-conductive areas formed between the microphone connector and a microphone capable of transmitting signal stably through the multi-conductive areas.

According to the invention, the microphone connector includes an insulation housing and an electrical contact. The insulation housing has an insertion passage formed on a top surface thereon, a receiving space arranged at a bottom surface thereon and communicating to the insertion passage and grooves passing through opposite sidewalls of the insulation housing. The electrical contact includes a body portion arranged up on one of the sidewalls of the insulation housing, a soldering portion arranged at one end of the body portion, at least two opposite arms arranged at the other end of the body portion and received in the corresponding grooves of the insulation housing respectively and elastic connection portions respectively arranged at the opposite arms and received in the receiving space of the insulation housing.

While the microphone connector engages with the microphone, a terminal of the microphone inserts into the insertion passage of the insulation housing and electronically couples to the elastic connection portions of the electrical contact to form multi-conductive areas between the terminal of the microphone and the elastic connection portions of the electrical contact. Therefore, the signal is transmitted between the microphone and the microphone connector stably through the multi-conductive areas between the terminal of the microphone and the elastic connection portions of the electrical contact of the microphone connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
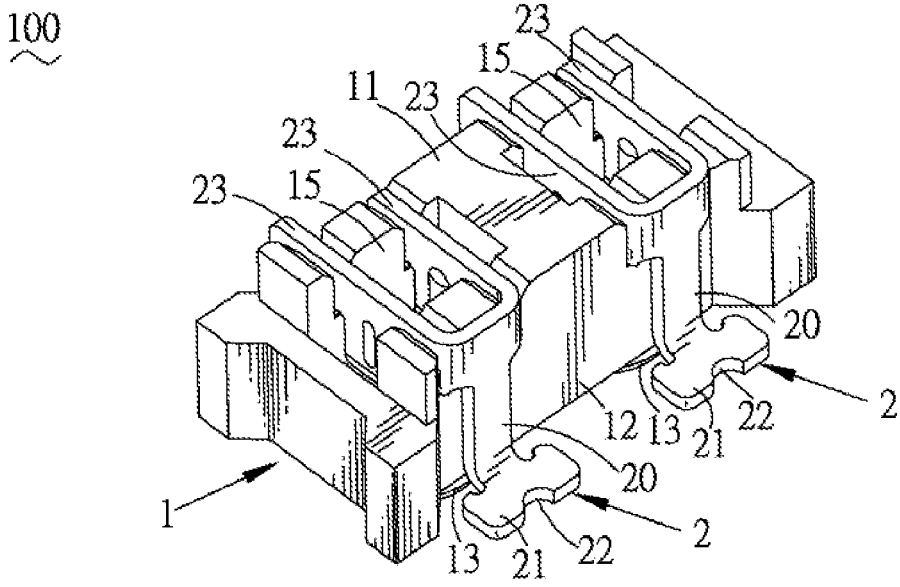
FIG. 1 is a perspective view of a first embodiment of a microphone connector according to the present invention.
Figure 2:
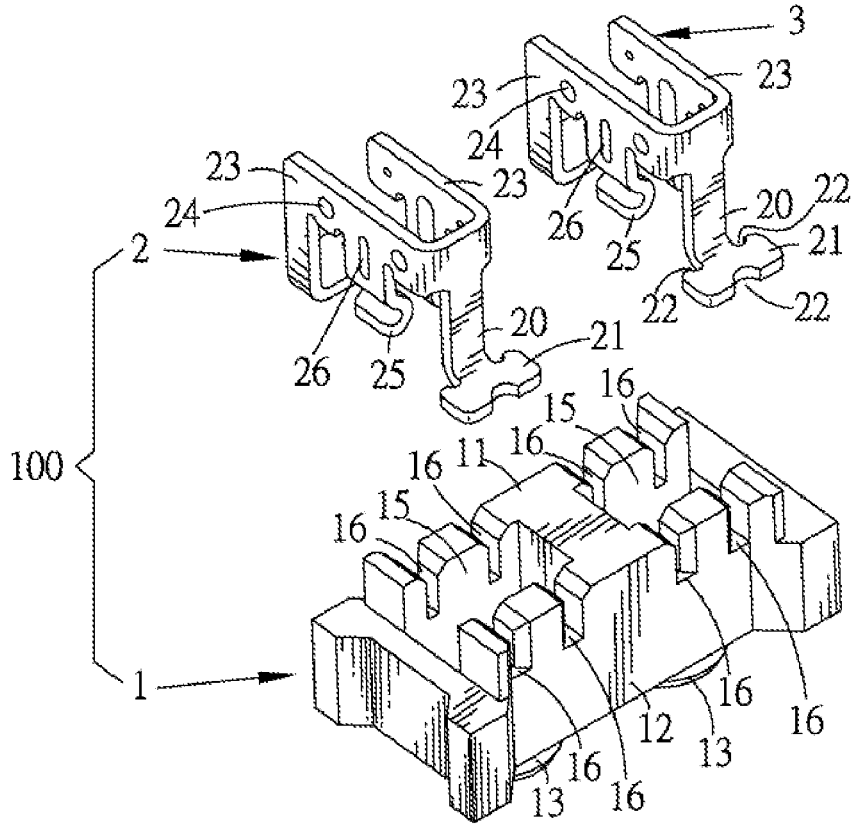
FIG. 2 is an exploded view showing a front side of the first embodiment of the microphone connector.
Figure 3:
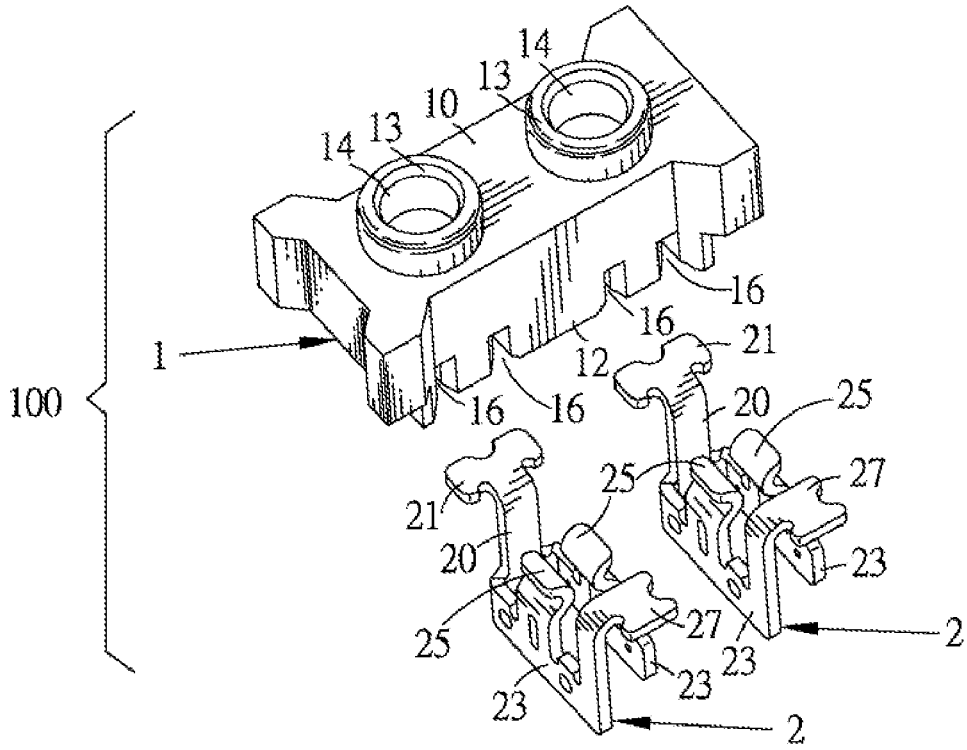
FIG. 3 is an exploded view showing a rear side of the first embodiment of the microphone connector.
Figure 4:
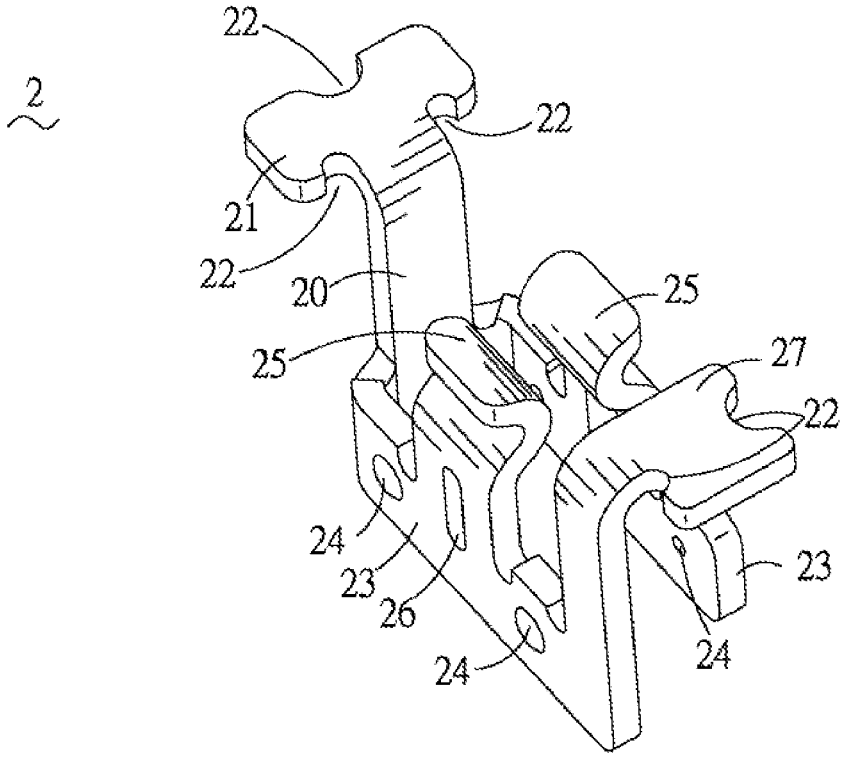
FIG. 4 is a perspective view showing an electrical contact of the first embodiment of the microphone connector.

Please refer to FIG. 1 to FIG. 3, which shows a first preferred embodiment of a microphone connector 100 according to the present invention. The microphone connector 100 disposes on a printed circuit board (not shown in figures) and engages with a microphone 5 (shown in FIG. 5). The microphone connector 100 has an insulation housing 1 and an electrical contact 2.

The insulation housing 1 has a top surface 10, a bottom surface 11 opposite to the top surface 10 and at least two opposite sidewalls 12 respectively connecting the top surface 10 and the bottom surface 11. A cyclic projection 13 is mounted on the top surface 10 of the insulation housing 1. Further, the printed circuit board has a through hole (not shown in figures) for receiving the cyclic projection 13 of the insulation housing 1.

An insertion passage 14 is received in the insulation housing 1 and perpendicular to the top surface 10 of the insulation 1. One end of the insertion passage 14 is opened on a central area of the cyclic projection 13. A receiving space 15 is also received in the insulation housing 1 and perpendicular to the bottom surface 11 of the insulation housing 1. One end of the received space 15 is opened on the bottom surface 11 of the insulation 1. The other end of the receiving space 15 partially communicates the other end of the insertion passage 14. Plurality of grooves 16 are arranged to through the sidewalls 12 and communicated the receiving space 15 respectively.

Referring to FIG. 1 to FIG. 4, the electrical contact 2 has a body portion 20 arranged up on one of the sidewalls 12 and parallel to the sidewalls 12 of the insulation housing 1. One end of the body portion 20 is extended and curved to form a first soldering portion 21, which is parallel to the top surface 10 of the insulation housing 1 and soldered to the printed circuit board. At least one indentation 22 is arranged at edges of the first soldering portion 21 for engaging with soldering tin on the printed circuit board quickly, especially through surface mount technology. Therefore, the first soldering portion 21 of the electrical contact 2 is soldered to the printed circuit board quickly due to the indentation 22 of the electrical contact 2 quickly engaging with the soldering tin on the printed circuit board.

At least two opposite arms 23, which are perpendicular to the body portion 20 and received in the corresponding grooves 16 of the insulation housing 1, are extended and curved from opposite sides of the other end of the body portion 20 respectively. At least two projections 24 corresponding to the grooves 16 of the insulation housing are mounted on the each side arm 23 of the electrical contact 2. While the electrical contact 2 and the insulation housing 1 are assembled, the opposite arms 23 are received in the corresponding grooves 16 of the insulation 1 respectively and the projections 24 of the electrical contact 2 are rubbed on inner surface of the grooves 16 respectively. Therefore, the electrical contact 2 engages with the insulation housing 1 due to the projection 24 of the electrical contact 2 rubbed on the inner surface of the grooves 16 of the insulation housing 1.

Still Referring to FIG. 1 to FIG. 4, At least two elastic connection portions 25 are arranged at a central area of one edge of the opposite arms 23 respectively and received in the receiving space 15 of the insulation 1. In this case, the elastic connection portions 25 are curved and formed an arc-shape and projecting each other. Ribs 26 are arranged between the opposite arms 23 and the elastic connection portions 25 respectively and projecting each other. While the microphone connector 100 engages with the microphone 5 and a terminal 50 of the microphone 5 pushes the elastic connection portions 25 of the electrical contact 2, the ribs 26 strengthen the connection between the elastic connection portions 25 and the opposite arms 23.

A second soldering portion 27 is extended from a free end of one of the arms 23 and curved toward the other arm 23 for soldering to the printed circuit board. The second soldering portion 27 is also parallel to the top surface 10 of the insulation housing 1. The second soldering portion 27 also has the indentations 22 arranged at its edges for engaging with the soldering tin on the printed circuit board. Consequently, the second soldering portion 27 of the electrical contact 2 is soldered to the printed circuit board quickly due to the indentation 22 of the electrical contact 2 quickly engaging with the soldering tin on the printed circuit board.

Figure 5:
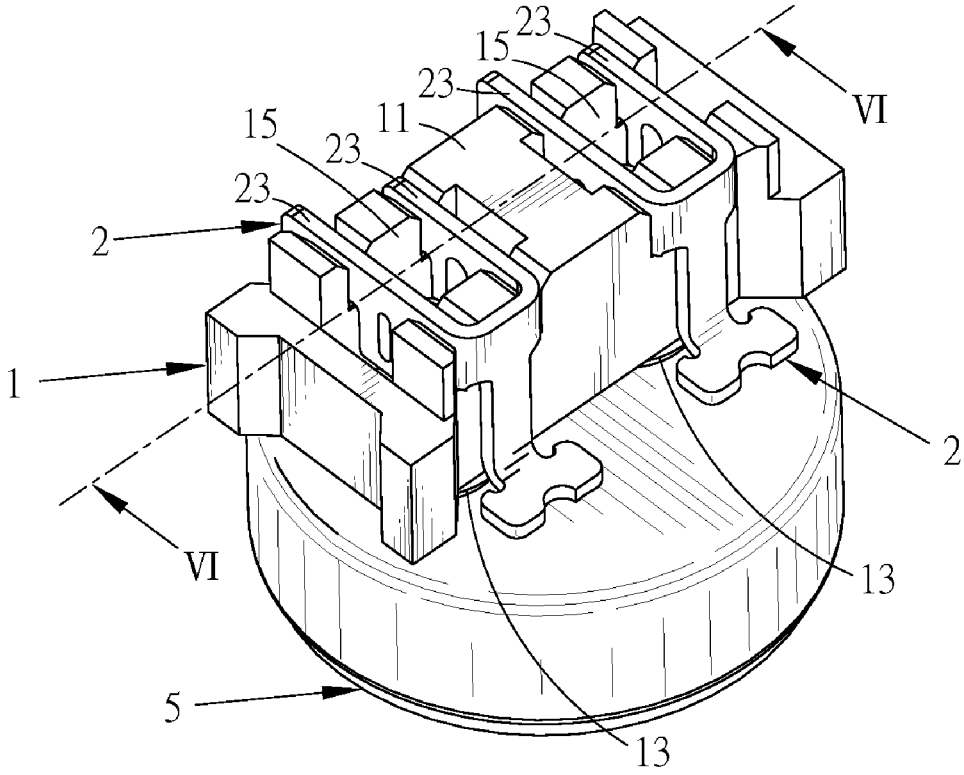
FIG. 5 is a perspective view showing a microphone engaged with the microphone connector.
Figure 6:
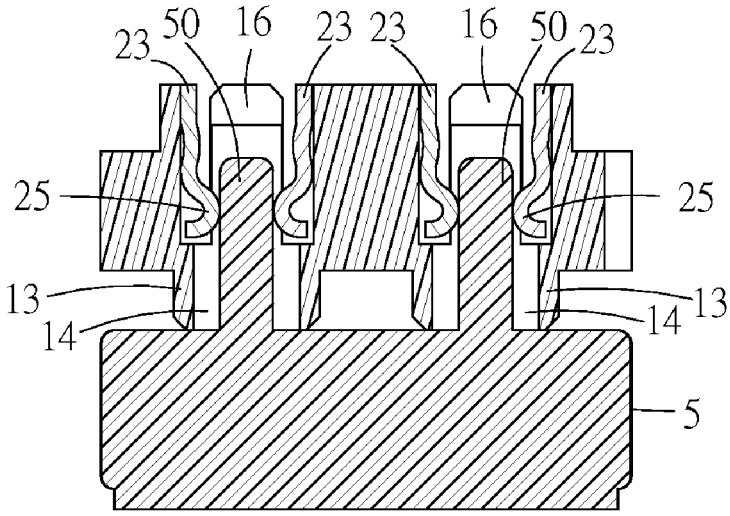
FIG. 6 is a cross-sectional view showing the microphone engaged with the microphone connector along line VI-VI.
Figure 7:
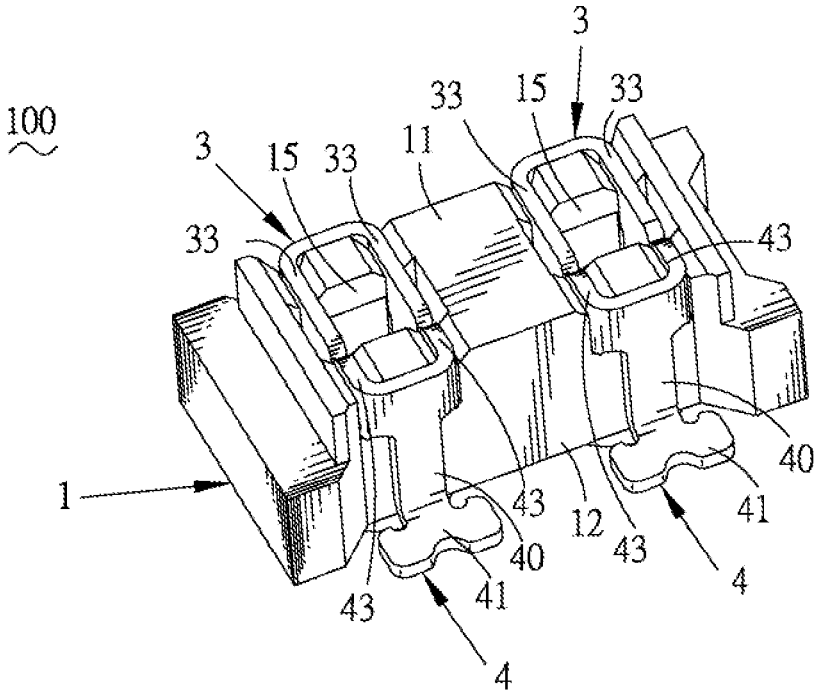
FIG. 7 is a perspective view of a second embodiment of a microphone connector according to the present invention.
Figure 8:
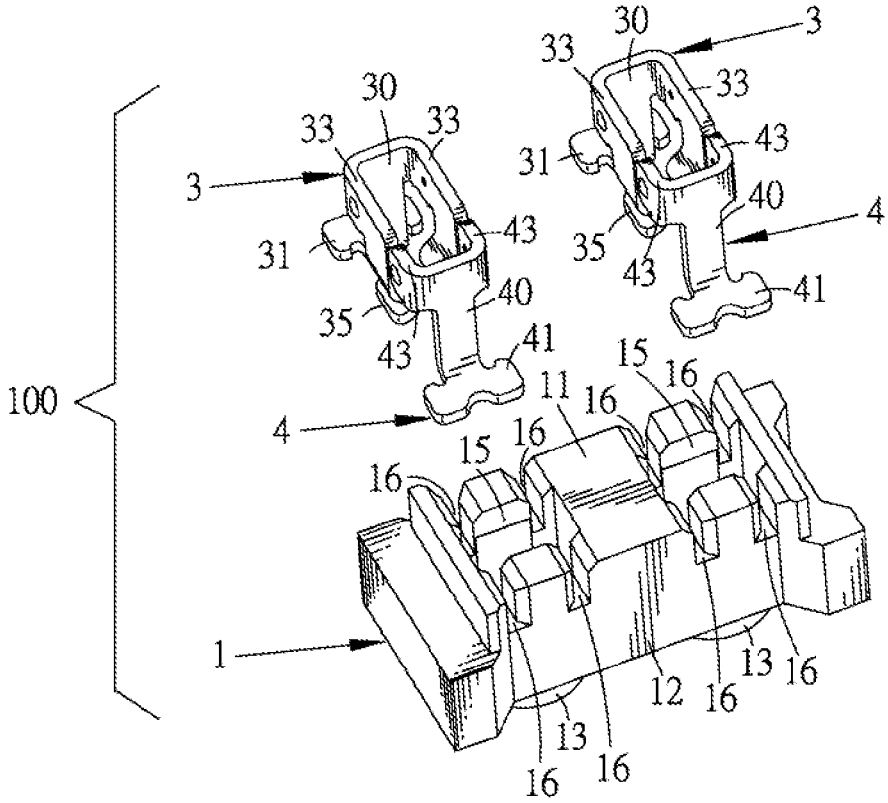
FIG. 8 is an exploded view showing a front side of the second embodiment of the microphone connector.
Figure 9:
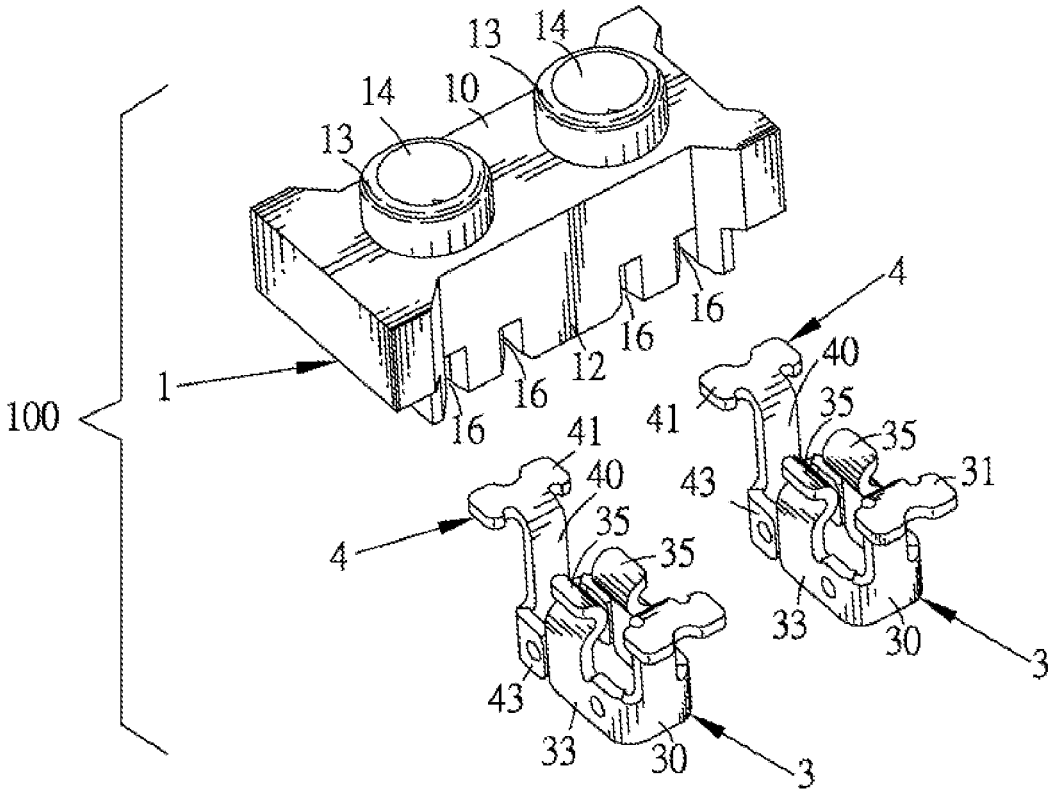
FIG. 9 is an exploded view showing a rear side of the second embodiment of the microphone connector.
Figure 10:
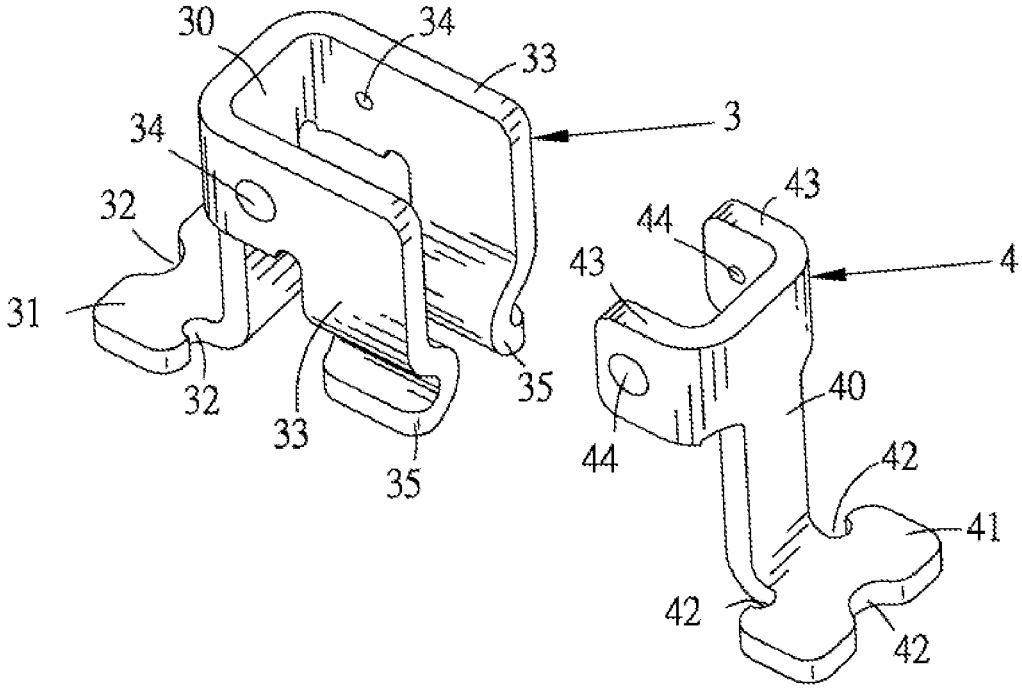
FIG. 10 is a perspective view showing a first electrical contact and a second electrical contact of the second embodiment of the microphone connector.

Please refer to FIG. 5 and FIG. 6. While the microphone connector 100 engages with the microphone 5, the terminal 50 of the microphone 5 inserts into the insertion passage 14 of the insulation housing 1. The terminal 50 of the microphone 5 pushes the elastic connection portions 25 of the electrical contact 2 and electronically couples to the elastic connection portions 25 to form multi-conductive areas between the terminal 50 of the microphone 5 and the elastic connection portions 25 of the electrical contact 2 of the microphone connector 100. Therefore, signal is transmitted between the microphone connector 100 and the microphone 5 stably through the multi-conductive areas.

Referring to FIG. 7 to FIG. 10, which shows a second preferred embodiment of a microphone connector 100 according to the present invention. The electrical contact 2 is substituted for a first electrical contact 3 and a second electrical contact 4 arranged opposite to the first electrical contact 3. The first electrical contact 3 and the second electrical contact 4 have a first body portion 30 and a second body portion 40 respectively. The first body portion 30 of the first electrical contact 3 is parallel to the sidewalls 12 and arranged up on one of the sidewalls 12. The second body portion 40 of the second electrical contact 4 is also parallel to the sidewalls and arranged up on the other sidewall 12.

One end of the first body portion 30 and one end of the second body portion 40 are extended and curved to form a third soldering portion 31 and a fourth soldering portion 41 respectively for soldering to the printed circuit board. The third soldering portion 31 and the fourth soldering portion 41 are parallel to the top surface 10 of the insulation housing 1. The third soldering portion 31 and the fourth soldering portion 41 respectively have indentations 32, 42 arranged at edges of the third soldering portion 31 and edges of the fourth soldering portion 41 for engaging with the soldering tin on the printed circuit board quickly. According to the indentations 32, 42 engage with the soldering tin on the printed circuit board quickly, the third and fourth soldering portions 31, 41 are soldered to the printed circuit board quickly, especially through surface mount technology.

At least two opposite first arms 33 and opposite second arms 43, which are perpendicular to the first body portion 30 and the second body portion 40 respectively and received in the corresponding grooves 16 at the different sidewalls 12 of the insulation housing 1, are extended and curved from opposite sides of the other end of the first body portion 30 and opposite sides of the other end of the second body portion 40 respectively. Each the first arms 33 and the second arms 43 respectively have at least one first projection 34 and second projection 44 respectively corresponding to the grooves 16 arranged at different sidewalls 12 of the insulation housing 1.

While the first electrical contact 3, the second electrical contact 4 and the insulation housing are 1 assembled, the first arms 33 and the second arms 43 are received in the corresponding grooves 16 at different sidewalls 12 of the insulation housing 1 respectively and the first projection 34 and the second projection 44 are rubbed on inner surface of the corresponding grooves 16 respectively. Therefore, the first electrical contact 3 and the second electrical contact 4 engage with the insulation housing 1 due to the first projection 34 and the second projection 44 rubbed on the inner surface of the corresponding grooves 16 of the insulation housing 1.

Still referring to FIG. 7 to FIG. 10, the first electrical contact 3 further has at least two first elastic connection portions 35. In this case, the first elastic connection portions 35 are arranged at one side of the other end of the opposite first arms 33 respectively. The first elastic connection portions 35 are perpendicular to the arms 33 and receiving in the receiving space 15 of the insulation 1. In this case, the first elastic connection portions 35 are curved and formed an arc-shape and projecting each other.

Figure 11:
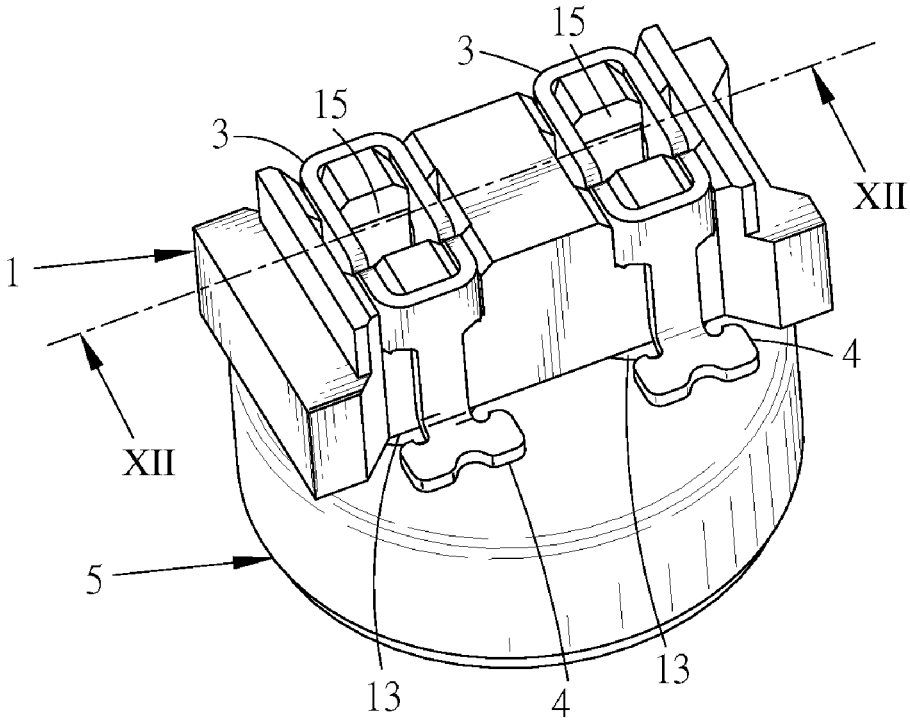
FIG. 11 is a perspective view showing the microphone engaged with the microphone connector.
Figure 12:
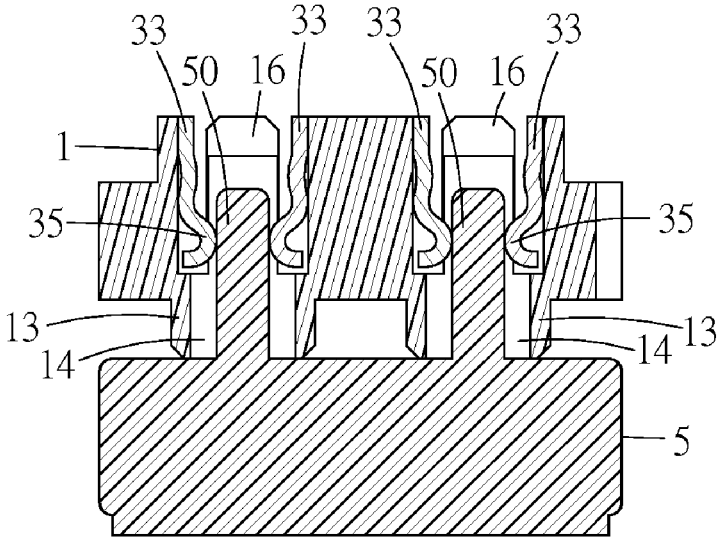
FIG. 12 is a cross-sectional view showing the microphone engaged with the microphone connector along line XII-XII.

Please refer to FIG. 11 and FIG. 12. While the microphone connector 100 engages with the microphone 5, the terminal 50 of the microphone 5 inserts into the insertion passage 14 of the insulation housing 1. The terminal 50 of the microphone 5 pushes the first elastic connection portions 35 of the first elastic electrical contact 3 and electronically couples to the first elastic connection portions 35 to form multi-conductive areas. Therefore, the signal is transmitted between the microphone connector 100 and the microphone 5 stably through the multi-conductive areas.

Furthermore, the present invention is not limited to the embodiments described above; various additions, alterations and the like may be made within the scope of the present invention by a person skilled in the art. For example, respective embodiments may be appropriately combined.

What is claimed is:

1. A microphone connector comprising:

an insulation housing comprising:

a top surface;

a first sidewall connected to said top surface;

a second sidewall connected to said top surface and parallel with said first side wall;

at least one insertion passage opened on said top surface;

at least one receiving space defined by said top surface, said first sidewall and said second sidewall and connected to said insertion passage;

a first groove penetrated through said first sidewall and connected to said receiving space; and a second groove penetrated through said first sidewall, parallel with said first groove and connected to said receiving space;

a third groove penetrated through said second sidewall, aligned with said first groove and connected to said receiving space;

a fourth groove penetrated through said second sidewall, aligned with said second groove and parallel with said third groove and connected to said receiving space of said insulation housing;

a first electrical contact comprising:

a first body portion adjacent to an outer surface of said first sidewall of said insulation housing and extending toward said top surface of said insulation housing;

a first soldering portion bent and extended outwardly from one end portion of said first body portion, which is at a same level with said top surface of said insulation housing;

a first arm bent and extended from a first edge of other end portion of said first body portion and passed through said first groove of said insulation housing;

a second arm bent and extended from a second edge of other end portion of said first body portion, and passed through said second groove of said insulation housing, said first edge opposite to said second edge, said first arm and second arm faced and parallel to each other;

a first elastic connection portion extended from an edge of said first arm and toward said top surface, and received in said receiving space of said insulation housing; and a second elastic connection portion extended from an edge of said second arm and toward said top surface and received in said receiving space of said insulation housing, said first elastic connection portion and said second connection portion opposite to each other and perpendicular to said first body portion; and a second electrical contact opposite to and aligned with said first electric contact, having a second body portion opposite to and aligned with said first body portion, said second body portion adjacent to an outer surface of said second sidewall of said insulation housing and extended toward said top surface of said insulation housing;

a second soldering portion bent and extended outwardly from one end of said second body portion and substantially at a same level with said top surface of said insulation housing;

a third arm bent and extended from the a first edge of other end portion of said second body portion and passed through said third groove of said insulation housing, said third arm and said first arm aligned to each other, free end of said first arm and free end of said third arm are against each other;

a fourth arm bent and extended from the a second edge of other portion end of said second body portion and passed through said fourth groove of said insulation housing, said first edge opposite to said second edge, said third arm and said fourth faced and parallel to each other, said fourth arm and said second arm aligned to each other, free end if said second arm free end of said fourth arm are against each other.

2. The microphone connector as claimed in claim 1, wherein said insulation housing has at least one circular projection arranged on said top surface and said insertion passage is formed in the central area of said circular projection.

3. The microphone connector as claimed in claim 1, wherein said first soldering portion is perpendicular to said first body portion.

4. The microphone connector as claimed in claim 1, further comprising at least one indentation formed on the edge of said first soldering portion of said first electrical contact.

5. The microphone connector as claimed in claim 1, further comprising a plurality of projections formed on said first arm and said second arm of said first electrical contact and corresponding to said first groove and said second groove of said insulation housing respectively.

6. The microphone connector as claimed in claim 1, wherein said first elastic connection portion and said second elastic connection portion are curved to form an arc-shape respectively.

7. The microphone connector as claimed in claim 1, further comprising a first rib formed between said first arm and said first elastic connection, and a second rib mounted between said second arm and said second elastic connection portion.

8. The microphone connector as claimed in claim 1, further comprising at least one indentation formed on the edge of said second soldering portion.

9. The microphone connector as claimed in claim 1, further comprising a plurality of projections formed on said third arm and said fourth arm of said second electrical contact and corresponding to said third groove and said fourth groove of said insulation housing respectively.

10. The microphone connector as claimed in claim 1, wherein said second soldering portion is perpendicular to said second body portion.

* * * * *